United States Patent [19]

Carin

[11] 3,943,736

[45] Mar. 16, 1976

[54] OSCILLATORY PERIPHERAL AGITATION WASHING MACHINE

[76] Inventor: Jesus R. Carin, San Francisco, Bulacan, Bulacan, Philippines

[22] Filed: Mar. 12, 1975

[21] Appl. No.: 557,693

[30] Foreign Application Priority Data

Mar. 13, 1974 Philippines ..... 15615

[52] U.S. Cl. ..... 68/133; 68/134; 74/70; 134/188; 134/189; 259/101

[51] Int. Cl.[2] ..... D06F 13/02; D06F 17/10

[58] Field of Search ..... 68/131–134, 68/63, 89, 92, 174, 175; 259/101, 114, 117; 74/70; 134/187, 188, 189

[56] References Cited

UNITED STATES PATENTS

| | | | |
|---|---|---|---|
| 2,441,723 | 5/1948 | Siefert | 68/133 |
| 2,516,655 | 7/1950 | Smith | 68/174 |
| 2,575,691 | 11/1951 | Smith | 68/134 X |

*Primary Examiner*—Stanley N. Gilreath
*Assistant Examiner*—Philip R. Coe
*Attorney, Agent, or Firm*—Sughrue, Rothwell, Mion & Zinn

[57] ABSTRACT

The present invention relates to a washing machine and more particularly to a portable, peripheral oscillating agitation dual purpose washing machine. It is capable of cleaning out dirt materials from fabrics and dinner wares. It comprises a cylindrical enclosure including roller means as a base for portability, an inner cylinder acting as a washing chamber or tub where materials to be washed are deposited, an agitator peripherally disposed inside the tub which oscillates by means of a linkage connected to a worm and worm-gear means powered preferably by an electric motor installed underneath. As the agitator rotatively oscillates the water and soap solution is propelled towards the center at a certain speed and direction opposite that of the materials to be washed thereby achieving a very efficient washing process.

6 Claims, 4 Drawing Figures

FIG. 3
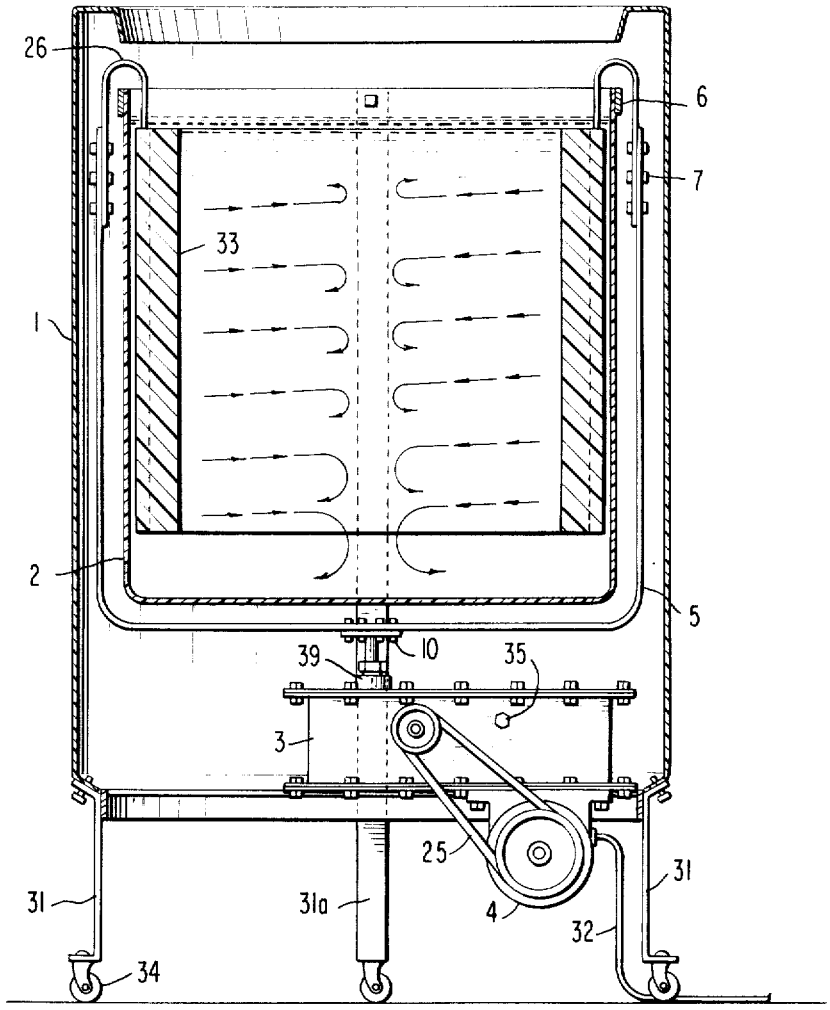
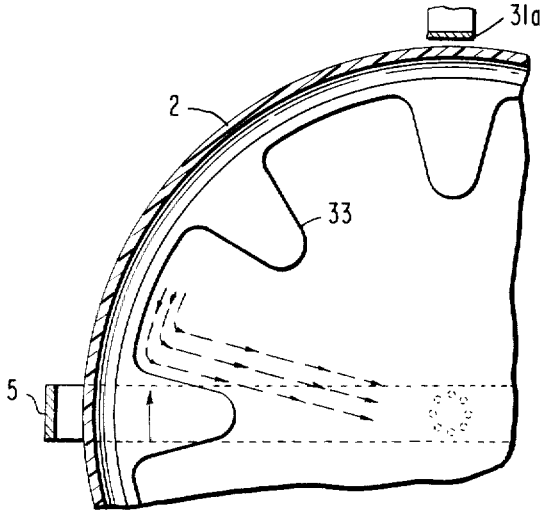
FIG. 4

OSCILLATORY PERIPHERAL AGITATION WASHING MACHINE

BACKGROUND AND OBJECTS

The known washing machines currently in use and in prior art literature usually comprise a shell, an inner cylinder or tub, a prime mover and an impeller which is either a multi-bladed propeller installed at the lower recessed side of the tube or an elongated four-cornered piece installed vertically at the center of the tub. In the former, tangential flow of the water is effected with the section directly in the path of the current attaining maximum cleaning process while the rest considerably less. Moreover, uni-directional flow results thereby decreasing the relative velocity of solid materials and the soap solution lessening further its cleaning efficiency. Obviously, the overall efficiency of such a unit is low with characteristically uneven cleaning. In the latter, wherein the agitator is installed at the center of the tub, it is fairly obvious that the effective volume where the cleaning process occur is reduced. Again, the effectivity of the washing process is concentrated in that area immediately surrounding the agitator with the outermost section having the least efficiency. With the agitator so located it will not be practical to utilize the unit for cleaning dinner wares as the chances for breakage are quite apparent. Compounding these inherent defects is the fact that in almost all the models cited the power shaft actuating the propeller or agitator penetrates the tub which will therefore require sealing to prevent leaks which will certainly hasten the deterioration of the parts and causing damage to the motor. As can be observed, in actual cases, these destructive events occur in most models because of the failure of the seal.

Due to their peculiar construction, strong materials, such as stainless steel, are used for the tub and mild steel plate with enamel paint finish for the shell. The impeller is made of hard rubber. All these add immersely to the cost of the machine.

The aforementioned disadvantages are eliminated by the present invention wherein the power shaft does not penetrate the bottom wall of the tub to actuate the agitator. Rather, the link-up with the agitator is effected by a yoke-like structure connected at its base to a rotatively oscillating shaft while its two vertically extending arms are bent 180 degrees to enter the tub at its upper end on opposite points and connect with the agitator. Sealing is thus dispensed with. This condition is made possible by the unique design and construction of the agitator. Briefly stated, the agitator is similar to a widely spaced, involutely and internally serrated cylinder dimensioned to leave adequate clearance with the inner wall of the tub. As it oscillates rotatively, each serration propels a jet of water toward the center of the tub with a direction opposite that of the fabric material. High relative velocity between the former and the latter is thus assured favoring, in turn, high cleansing efficiency. In addition to these, even distribution of the effective washing volume to practically the entire tub results aside from making the effective washing volume of the tub itself comparatively larger owing to the peripherally located agitator. Moreover, this unique design enables one to safely and effectively wash dinner wares as the danger of breakage is nil. Further, the construction itself does not require strong materials. Hence, light materials such as fiberglass may be used for the shell, the tub and the agitator making the machine not only cheap but also corrosion-free. Further, the bearings and the rubbing surfaces are located in a closed compartment provided with lubricating material.

It is therefore the principal object of this invention to provide a washing machine with an agitator peripherally located inside the tub.

Another object of this invention is to provide a washing machine with a leakproof tub.

A further object of this invention is to provide a washing machine which evenly distributes the effective washing volume throughout the tub.

Another object of this invention is to provide a washing machine with a comparatively large effective washing volume of the tub.

Another object of this invention is to provide a dual purpose washing machine, capable of washing both dinner wares and fabrics.

A further object of this invention is to provide a washing machine that is simply constructed and utilizing light materials, cheap and effective.

Another object of this invention is to provide a washing machine that is portable, highly efficient with rubbing surfaces constantly and adequately lubricated.

BRIEF DESCRIPTION OF THE DRAWINGS

In the accompanying drawings:

FIG. 3 is a detailed sectional view of the machine in FIG. 1 taken substantially along section line "A—A" showing direction of the water designated by arrows; and FIG. 4 is a detailed sectional view of a quadrant of the agitator showing the direction of the water designated by arrows.

DESCRIPTION OF THE PREFERRED EMBODIMENT OF THE INVENTION

Figure 1:
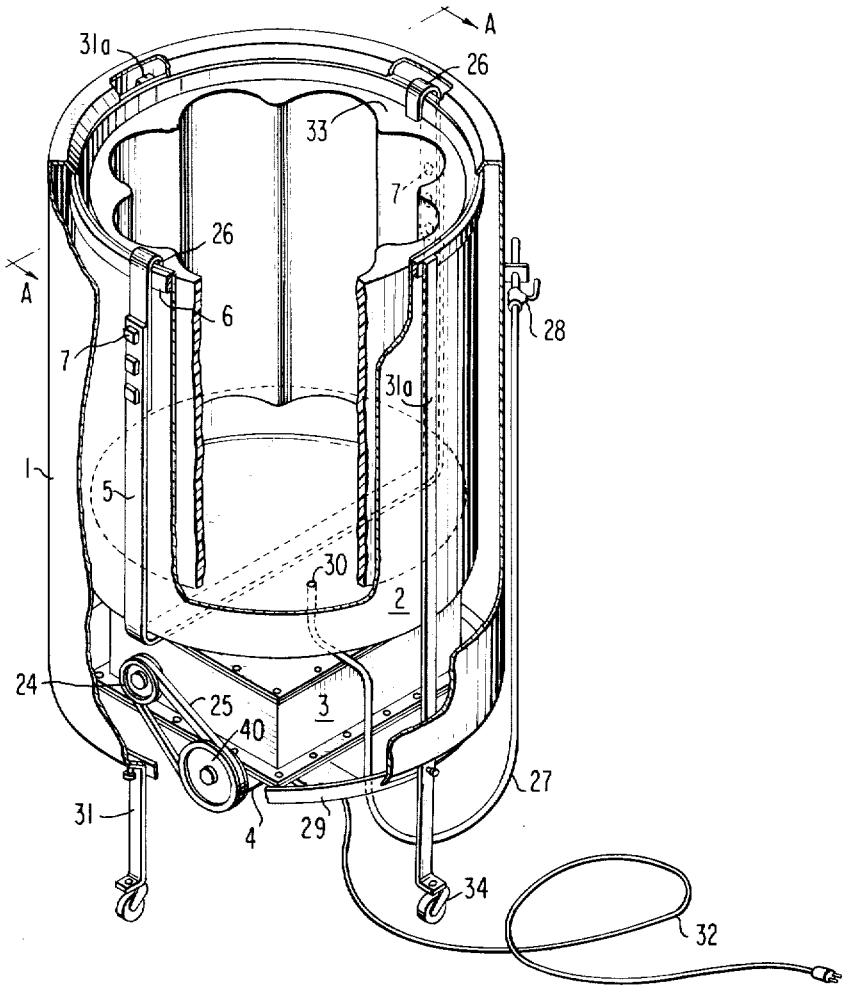
FIG. 1 is a perspective cut-away view of the peripheral agitation washing machine shown completely assembled.

The present invention as shown in FIG. 1, comprises of five basic parts, namely: shell 1, inner shell or tub 2, the agitator 33, the gear box and linkage assembly 3 and the prime mover 4.

The shell 1 protects the inner parts of the machine while acting as a protective guard to prevent injury to persons. It is a thin-walled cylinder set upright and bolted at its lower ends to the upper edge of short legs 31. (SEE FIG. 3). The inner shell 2, hereinafter referred to as the tub, is likewise cylindrical with its bottom closed. It is disposed inside said shell 1 with an adequate clearance and is provided with ring plate 6 tightly gripping its upper edge through which it is supported by the opposed elongated legs 31a firmly attached to it at their ends. Rollers 34 are provided at the lower ends of members 31 and 31a to lend the machine portability. The shell, therefore, is amply supported and is independent of the tub. According to the embodiment shown, the shell and the tub are made of fiberglass while the legs and the ring plate are metallic. The invention, however, is not limited by the above-cited materials.

Figure 2:
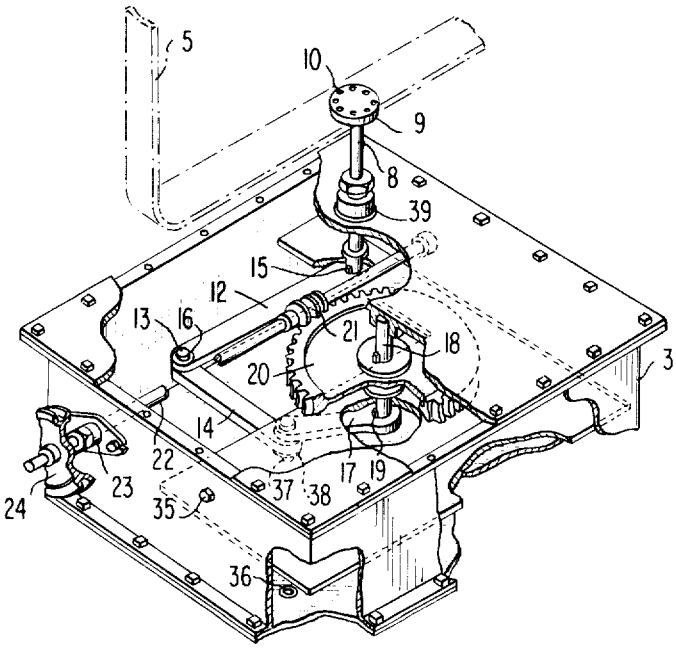
FIG. 2 is a detailed perspective view of the yoke and gear box assembly showing the three-piece linkage and the worm and wormgear.

The agitator 33 has a plainly cylindrical outer surface (SEE FIG. 1 and FIG. 4) peripherally situated inside the tub 2 and dimensioned to leave adequate clearance with the outer wall and the bottom of the latter. Its inner wall is formed in a manner similar to a widely spaced, involutely and internally serrated cylinder. It is hangingly supported by the bent pieces 26 (SEE FIG. 1 and FIG. 3) at opposite points on its upper edge with member 26 so formed and positioned as not to touch any part of said tub 2. The lower portions of said bent pieces 26 may be firmly attached to the corresponding upper portions of yoke 5 by any means such as bolts 7 and are, according to the embodiment shown, preferably made of the same material as the agitator 33. Said yoke 5 is firmly supported at the center of its base by the flange 9 of stub shaft 8 through bolts 10 (SEE FIG. 2) with the latter supported by bearings 39 situated at the upper and bottom walls of gear box 3. One end of rocker arm 12 is connected by key 15 to the lower portion of said stub shaft 8 while its other end is pivotally connected by pin 13 and retaining ring 16 to one end of connecting rod 14 whose other end is likewise pivotally connected by pin 37 and retaining ring 38 to one end of crank 17 whose other end, in turn, is connected by key 19 to the counter shaft 18. Thus members 12, 14 and 17 complete a three-piece linkage converting a purely rotative motion of the latter into a rotatively oscillating motion of the first member. The event is translated all the way to the agitator 33 which is now obvious.

Counter shaft 18 is likewise journalled to the upper and bottom walls of member 3 and rotates with gear 20 which is driven by worm 21 keyed to line shaft 22 which is in turn journalled by bearings 23 to the opposite side walls of gear box 3 and provided with an overhang to accommodate power transmission means such as pulley 24.

Power is derived preferably from an electric motor 4 installed underneath gear box 3 through drive pulley 40 and belt 25 connecting the latter to said pulley 24. Said gear box 3 is totally enclosed, supported structurally by legs 31 and is provided with a lubricant oil inlet hold and plug 35 and drain hole and plug 36. Electric line and plug 32 provides convenient connection to any outlet socket. The tub 2 is provided with drain hole and hose 30 with stop cock 28 affording convenient draining of the water and soap solution from it.

The cleaning process is achieved very efficiently as the agitator 33 is actuated in the manner explained earlier. The oscillating motion of the agitator along the periphery of the tub simulates hand washing including the wriggling movement imparted to the fabrics during the washing operation resulting in short jerking motions and rubbing of the fabric materials with each other which are primarily responsible for quick expulsion of dirt materials.

FIG. 3 and FIG. 4 illustrates the movement of the water and soap solution in the tub. With every stroke of the agitator, the direction of the said solution is reversed resulting in the opposite direction of motion between the cleansing agent and the materials to be cleaned. This inevitably results in a very efficient washing machine.

The foregoing is discriptive only of the embodiment shown and any alterations in construction, materials and design which fall within the scope of the appended claims shall be considered part of the invention.

I claim:

1. A washing machine comprising an outer open-ended cylindrical shell independently supported on legs; an inner bottom-closed cylinder disposed internally of said outer shell defining a fabric material or dinner wares washing chamber and provided with support means independent of said support legs of the outer shell; agitator means freely rotatable and disposed peripherally and internally of said inner cylinder, said agitator having an inner wall with equally spaced longitudinal projections throughout said inner wall to effect the creation of water jets directed toward the center of said inner cylinder when said agitator is actuated thereby effecting the washing of materials deposited within said inner cylinder, said agitator further having an upper edge; yoke support means having an upper portion and a base, said yoke support means supporting said upper edge of said agitator at said upper portion of said yoke support means, said yoke support means being supported at the base thereof by a shaft, a linkage means connected to said shaft, said linkage means translating a rotative input motion into a rotatively oscillating output motion thereby imparting similar motion to said agitator means by means of said yoke support means; a prime mover having an output; and power transmission means linking said prime mover output to said linkage means.

2. A washing machine as in claim 1 wherein said inner cylinder has an upper end, said support means of said inner cylinder comprises a ring plate firmly gripping said upper end of said inner cylinder and rigidly attached at opposite points to upper ends of a pair of elongated legs, respectively, said elongated legs together with said support legs of said outer shell provided with rollers, all of said legs having lower portions linked by a common link strip.

3. A washing machine as in claim 1 wherein said agitator means comprises a cylinder having a plain outer surface and an involutely serrated inner surface, said agitator being hangingly supported from its upper edge at opposite points thereof by bent ends of a pair of opposite elongated arms of said yoke support means, said elongated arms projecting vertically upward between said outer shell and said inner cylinder thereby providing support for said agitator without penetrating the bottom wall of the inner cylinder.

4. A washing machine as in claim 1 wherein said linkage means comprises a rocker arm keyed at one end thereof to said shaft supporting said yoke, a connecting rod pivotally connected at one end to the other end of said rocker arm, a rotating arm having a free end, said free end being connected to the other end of said connecting rod, said power transmission means having an output shaft, said rotating arm being keyed to said output shaft of said power transmission means thereby translating rotary input motion into rotatively oscillating output motion.

5. A washing machine as in claim 1 wherein said power transmission means comprises a worm and wormgear assembly driving said linkage means and further including a pulley and belt combination transmitting power from the prime move to said worm and wormgear assembly.

6. A washing machine as in claim 5 wherein said linkage means including said worm and wormgear assembly are housed inside a box-like compartment installed underneath said inner cylinder, said box provided with inlet and drainage means for lubricating oil.

* * * * *